US011998826B1

(12) United States Patent
Robinson

(10) Patent No.: US 11,998,826 B1
(45) Date of Patent: Jun. 4, 2024

(54) SPORTS APPARATUS WITH PIEZOCHROMIC STRIKE AREA

(71) Applicant: Brooks River Robinson, Kernersville, NC (US)

(72) Inventor: Brooks River Robinson, Kernersville, NC (US)

( * ) Notice: Subject to any disclaimer, the term of this patent is extended or adjusted under 35 U.S.C. 154(b) by 825 days.

(21) Appl. No.: 17/022,686

(22) Filed: Sep. 16, 2020

Related U.S. Application Data

(60) Provisional application No. 62/900,852, filed on Sep. 16, 2019.

(51) Int. Cl.

| | |
|---|---|
| ***A43B 5/02*** | (2006.01) |
| ***A43B 3/34*** | (2022.01) |
| ***A43B 3/44*** | (2022.01) |
| ***A63B 24/00*** | (2006.01) |
| ***A63B 71/06*** | (2006.01) |
| *A63B 71/00* | (2006.01) |

(52) U.S. Cl.
CPC ..... *A63B 71/0622* (2013.01); *A43B 3/34* (2022.01); *A43B 3/44* (2022.01); *A43B 5/02* (2013.01); *A63B 24/0062* (2013.01); *A63B 2071/0063* (2013.01); *A63B 2071/065* (2013.01); *A63B 2071/0661* (2013.01); *A63B 2220/53* (2013.01)

(58) Field of Classification Search
CPC ..... A63B 71/0622; A63B 3/34; A63B 3/44; A63B 5/02; A63B 24/0062; A63B 2071/0063; A63B 2071/065; A63B 2071/0661; A63B 2220/53; A43B 5/02
See application file for complete search history.

(56) References Cited

U.S. PATENT DOCUMENTS

| | | | | |
|---|---|---|---|---|
| 9,170,419 | B2 | 10/2015 | Charlson et al. | |
| 10,821,343 | B1 * | 11/2020 | Chavan | A63B 53/14 |
| 11,479,886 | B2 * | 10/2022 | Abouraddy | D03D 15/533 |
| 2008/0254907 | A1 * | 10/2008 | Swartz | G01L 5/0052 374/E11.018 |
| 2012/0295723 | A1 * | 11/2012 | Beck | A63B 71/0622 473/549 |
| 2013/0017948 | A1 * | 1/2013 | Charlson | G02B 26/007 503/201 |
| 2014/0054827 | A1 * | 2/2014 | Mullane | A61F 13/513 264/405 |
| 2015/0045130 | A1 * | 2/2015 | Roach | A63B 60/02 473/226 |
| 2016/0346659 | A1 * | 12/2016 | April | A63B 71/0622 |
| 2017/0332737 | A1 * | 11/2017 | Glancy | A43C 15/162 |
| 2018/0117408 | A1 * | 5/2018 | Meetin | A63B 24/0021 |
| 2018/0339202 | A1 * | 11/2018 | Molinari | A63B 43/06 |
| 2019/0383585 | A1 * | 12/2019 | Boring | F41J 5/24 |
| 2020/0253319 | A1 * | 8/2020 | Patel | A43B 13/189 |
| 2021/0291030 | A1 * | 9/2021 | Anousis | F41B 13/02 |
| 2023/0191214 | A1 * | 6/2023 | Phelan, Jr. | A63B 59/50 473/564 |

* cited by examiner

*Primary Examiner* — Joshua T Kennedy
(74) *Attorney, Agent, or Firm* — MacCord Mason PLLC

(57) ABSTRACT

Sports apparatus having a piezochromic strike area according to any of devices, systems, assemblies and methods are shown and described. A sports apparatus may include a defined area serving as a strike area, a pod containing at least one piezochromic material integrated with a surface of the sports apparatus, that changes color with an impact force. In some instances, an initial color state is reobtained over a period of time with an absence of impact strikes.

19 Claims, 9 Drawing Sheets

SPORTS APPARATUS WITH PIEZOCHROMIC STRIKE AREA

FIELD OF THE TECHNOLOGY

The present disclosure relates generally to sports apparatus having a piezoochromic strike area, and more particularly to piezochromic strike areas under high level impact.

BACKGROUND

In many sports, it is desirable to gather as much knowledge as possible about how a player is making contact with a ball and/or surface, and about the impact itself and/or the trajectory in which the player sends the ball after impact. The more information a player is able to gather in practice can often be the competitive difference in game play. Further, Applicant realizes any information able to be gathered from the impact could also assist in understanding potential injury occurring from the impact. Currently, efforts are being made toward computerizing player information, by way of example, tracking players' movement through GPS trackers and/or to place GPS trackers in a ball and to gather GPS generated information about players' movement, speed of play and ball trajectory.

While this type of information is able to provide valuable insight, the amount of computer generated information produced in this way is often daunting for the individual player to decipher, and while this type of data may be valuable to a collegiate program, many players need a more straightforward, simpler to interpret, quicker, cost efficient way to gain feedback on their practice and play. Younger players do not appreciate the complicated computerized statistics and all players desire instant feedback on their play. Sports equipment is expensive and often an apparatus to gauge one's play is a non-necessary expense over and above the required equipment, especially with youth development, and expensive apparatus are unattainable to may young athletes.

Many player injuries occur on fields without any video playback and occur too quickly to understand what actually may have caused injury in a collision. Applicant realizes that any information that can aid in understanding injury causation could help in diagnosis and recovery.

Applicant desires a cost effective and time-sensitive apparatus for use by players to provide feedback in sports actions, injury, and performance. It is to these and other challenges that inventions of the present disclosure are directed.

SUMMARY

In accordance with the present disclosure, piezochromic apparatuses, devices, assemblies and methods are provided for indicating a strike area in an economical, durable and aesthetically pleasing way, and the like. This disclosure provides an improved sports apparatus having piezochromic strike areas as devices, assemblies and methods that are reliable and fast feedback, efficient, more durable and more cost effective. Additionally, the piezochromic strike area is incorporated with the sports apparatus so as to not interrupt or interfere with the striking of a strike area and/or the striking of a ball.

In one embodiment, a sports apparatus having a piezochromic strike area includes a strike zone in an apparatus surface. The strike zone may be a defined area. The strike zone may be an area likely to strike another surface during a sporting event. The sports apparatus may include a piezochromic area in the strike zone. The piezochromic area may include one or more pods.

The pods may include a first material. The pods may include a second material. The materials may be gathered each to a surface and/or each in a layer. In some examples, a component from a first layer and a component from a second layer intermingle when a pressure is directed to the strike area to form a piezochromic strike area. The pods may have reinforcing structures. The pods may have impact resistant structures. The pods may have impact absorbing structures.

Still some embodiments include wherein a first material and a second material may be separated in a resting state and may be interspersed in an activated state. A pressure applied to the sports apparatus may act as a catalyst for the activated state in which a piezochromic reaction occurs. The piezochromic reaction may be reversable over time. The piezochromic reaction may be an indicator of where a pressure force took place on the sports apparatus.

Piezochromic strike areas as shown herein on any sports apparatus is considered within the scope of embodiments of the present disclosure.

The above summary was intended to summarize certain embodiments of the present disclosure. Embodiments will be set forth in more detail in the figures and description of embodiments below. It will be apparent, however, that the description of embodiments is not intended to limit the present inventions, the scope of which should be properly determined by the appended claims.

BRIEF DESCRIPTION OF THE DRAWINGS

Embodiments of the disclosure will be better understood by a reading of the Description of Embodiments along with a review of the drawings, in which.

DESCRIPTION OF EMBODIMENTS

Figure 1:
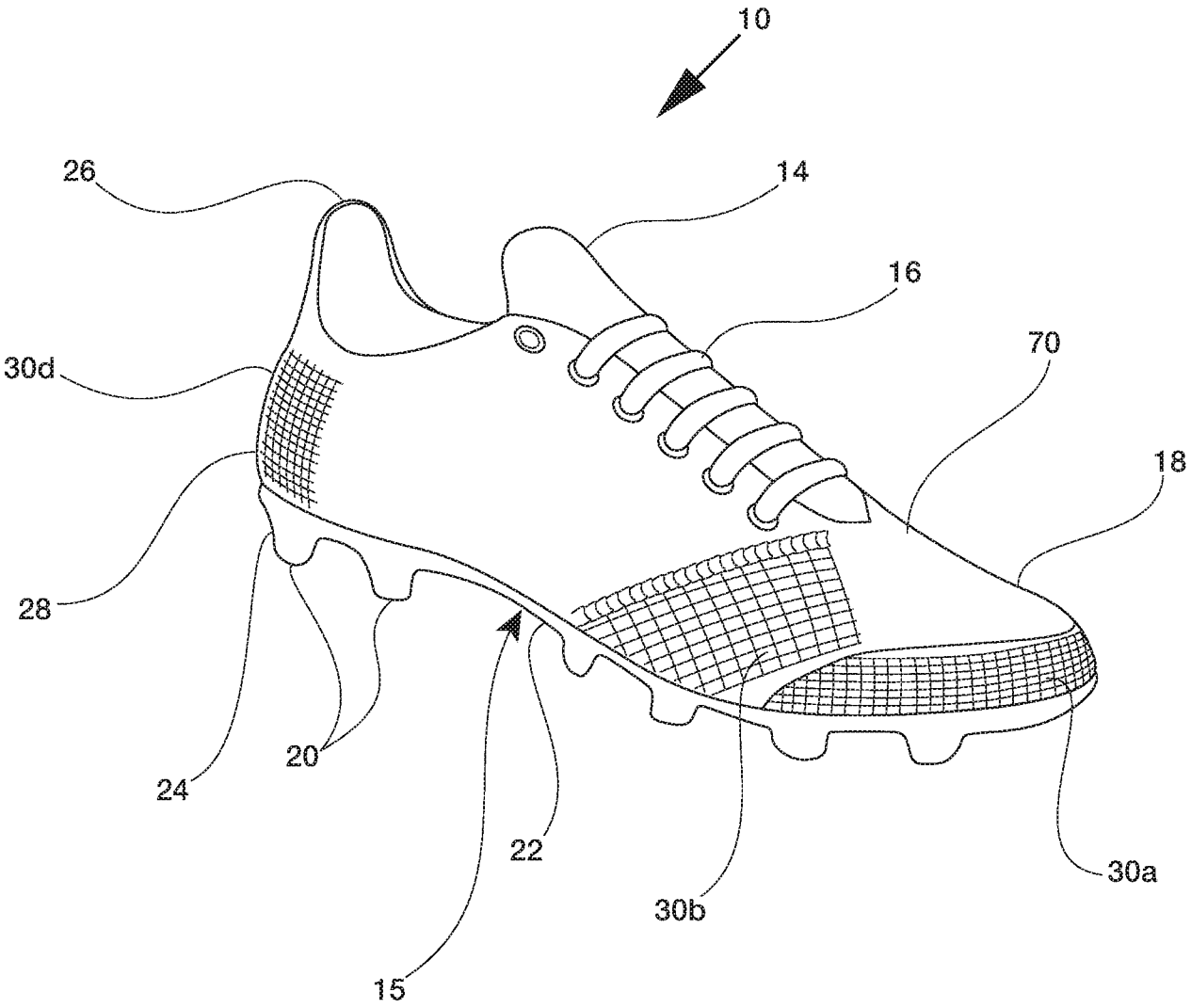
FIG. 1 is an outer perspective view of one example of a sports apparatus having a piezochromic strike area according to embodiments of the present disclosure.

In the following description, like reference characters designate like or corresponding parts throughout the several views. Also in the following description, it is to be understood that such terms as "forward," "rearward," "left,"

"right," "upwardly," "downwardly," and the like are words of convenience and are not to be construed as limiting terms.

Referring now to the drawings in general and FIG. 1 in particular, it will be understood that the illustrations are for the purpose of describing embodiments of the disclosure and are not intended to limit the disclosure or any invention thereto. FIGS. 1-9 introduce examples of a sports apparatus having a piezochromic strike area 10. By way of example, a sports apparatus includes any apparatus used in a sporting event, for example but not limited to, a sports cleat/shoe, a ball, a jersey, a wrist band, a racket, bat, a practice skin for a cleat, a helmet, and or a goal post.

The piezochromic strike area 30 may include, in some examples, a piezochromic pod 40. The piezochromic strike area 30 may include a series of piezochromic pods 40, and/or more than one piezochromic pods. The piezochromic pods 40 may be individual and/or may be adjoined. The piezochromic pod 40 may include a first fluid and/or first material 53. In some instances, the pod may include a second fluid and/or second material 56. The first fluid and the second fluid may be separated in a resting state and may be interspersed in an activated state, examples as seen in FIGS. 3, 5, 6, and 8. The pod 40 may include a coating 21 on an interior surface that imparts a property. The coating may include a high surface energy, a low surface energy, and/or a combination of both. In some examples, the fluid may be a high surface energy fluid and/or a low surface energy fluid. In examples, where the pod contains only one fluid, there may be empty space in part of the pod 40. The first fluid may include a pigment or dye and be, by way of example, a high surface energy fluid that preferentially wets a surface with a high surface energy and avoids surfaces with low surface energy and/or vice versa. When a force/pressure is applied to the pod 40, the fluid is spread inside the pod 40 to non-preferred surface areas entering the activated state. Once the force is removed, the fluid may matriculate back to the resting state. Fluids with differential surface energies may also be used together with interior pod surface areas of differential properties that serve to separate the fluids until a force is applied. The pod 40 may alternate between the resting state and the active state when a force is applied and removed and may cycle through the states as the force is applied and removed. The details of examples of a reversible piezochromic reaction system are shown and described in U.S. Pat. No. 9,170,419, to Charlson, which is herein incorporated in its entirety. The use of a piezochromic system in sports related settings and structures that are subject to repeated, forceful impacts is not contemplated or suggested by Charlson.

The pod 40 may include a first surface 52 and a second surface 55, with at least one of the surfaces being transparent and/or semitransparent. The pod may include a colored fluid and or colored gas. The pod may include a non-colored fluid and/or non-colored gas. A force applied to the pod 40 disburses the colored fluid or gas across the pod, causing a color change that is visible in one of the clear surfaces, in one example, as further described by Charlson.

The usage of a reversible piezochromic pod 40 in athletics, requires successful integration of the pod 40 into sports equipment that take repeated, non-predictable force applications and must be cost effective, non-hazardous, and durable. A problem applicant realized is that the pod 40 should be structured to include anti-crushing properties so that that pod 40 could sustain a force and survive to alternate through repeated force applications.

In one example, the inventions may include a pod 40 including a top surface 52', a bottom surface 55', and two side surfaces 41, 43. The top surface 52 may be at least partially transparent. The two side surfaces 41, 43 may include a shock-absorbing material to lessen the impact on the pod and/or on the top surface 52. At least the two side surfaces 41, 43 may include a shock-absorbing material. In one example a cushioned foam and/or rubber material may be included in the side surfaces, however, any shock-absorbing, durable material may be used and is considered within the scope of the inventions. In other examples, a network 51, such as a polymer or wire-based network, may be interlaced with a series of pods 40 to provide structure, stability and durability to the series of pods that resists crushing in a wire-based mesh/pod system.

Some examples include a pod 40 or series of pods (see FIG. 3 and FIG. 7 examples) having a flexible top surface 60. The pods may be imbedded in a structure so that the outer top surface 60 of the pod 40 is substantially flush with the outer surface of the structure in which it is embedded. The flexible top surface 60 of the pod 40 may have a flexibility equal to or exceeding the flexibility of the top surface of the structure in which it is embedded.

Other examples may include a pod 40 having at least one and/or two reinforced sides 44, 43. The bottom may be reinforced. The reinforced side 44, 43 may provide strength to the pod 40 to prevent crushing when a force is exerted. The reinforced sides may include a conductive material that distributes the impact of the force throughout the surrounding material to lessen the direct impact of the force on the pod itself. In one example, reinforced rods may occur on each pod side. In other examples, a micro cellular urethane foam with low compression set may be a suitable for use in one or more of the pod walls/sides. In other examples, a pod 40 may include a viscoelastic polymer as a protective layer at or in portions, sides and/or entirely in and/or around the pod 40, or incorporated in the pod 40. One example of a suitable viscoelastic polymer is a Sorbothane® viscoelastic polymer providing shock absorption along with structural memory and vibration damping, while also being durable.

Figure 6:
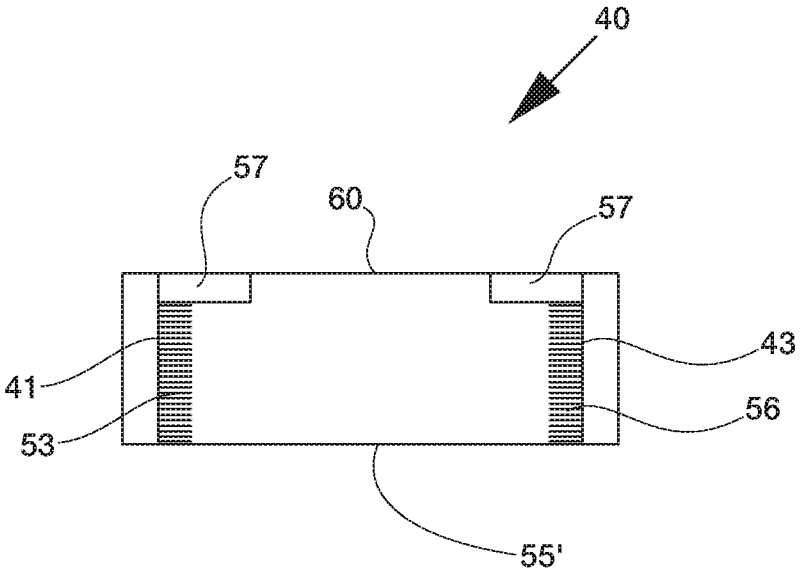
FIG. 6 shows another example of a piezochromic pod according to examples of the present disclosure.
Figure 7:
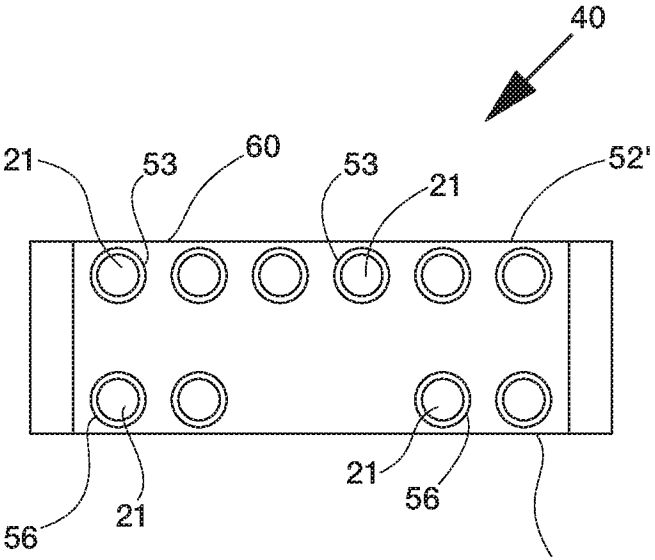
FIG. 7 shows another example of a piezochromic pod according to examples of the present disclosure.
Figure 8:
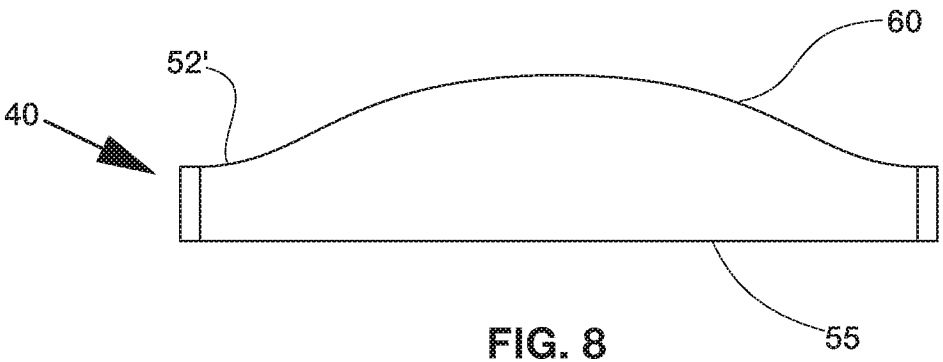
FIG. 8 shows one example of a side view of a piezochromic pod according to examples of the present disclosure.
Figure 9:
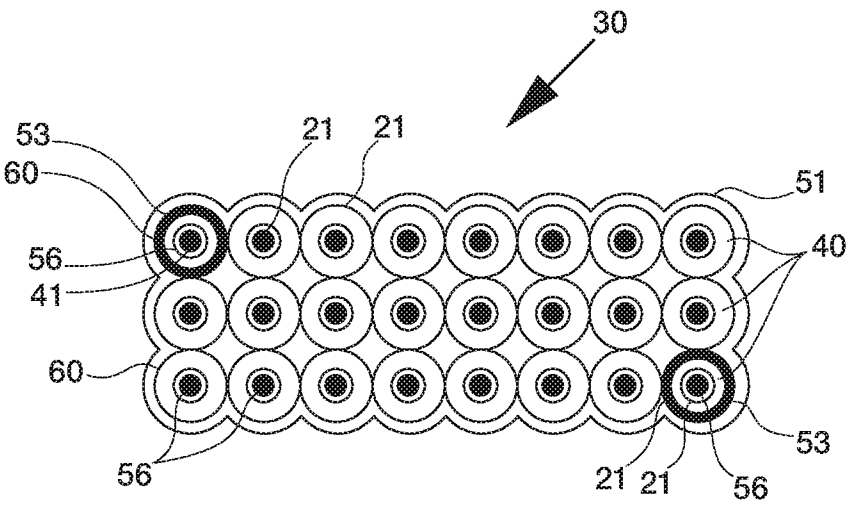
FIG. 9 shows another example of a piezochromic strike area according to examples of the present disclosure.

A pod 40, turning to FIG. 6, may by way of example include notches 57. Notches 57 may cover a portion of the outer top surface 60 from view from the outside of the cleat 70, and/or may serve as a shield hiding all or part of the first and/or second material 53, 56 from view. In other embodiments, examples as shown in FIGS. 6, 7 and 9, pods 40 and/or material portions of the pods 52, 53, 55, 56 may take on circular dimensions. The pod may be rounded, and/or first/second materials 53/56 may be attracted to rounded surfaces. The first and second materials 53/56 may be polar/non-polar and segregate from one another until a force is applied. The pod may include a transparent view field on one of the surfaces, for example one of the side surfaces.

Figure 2:
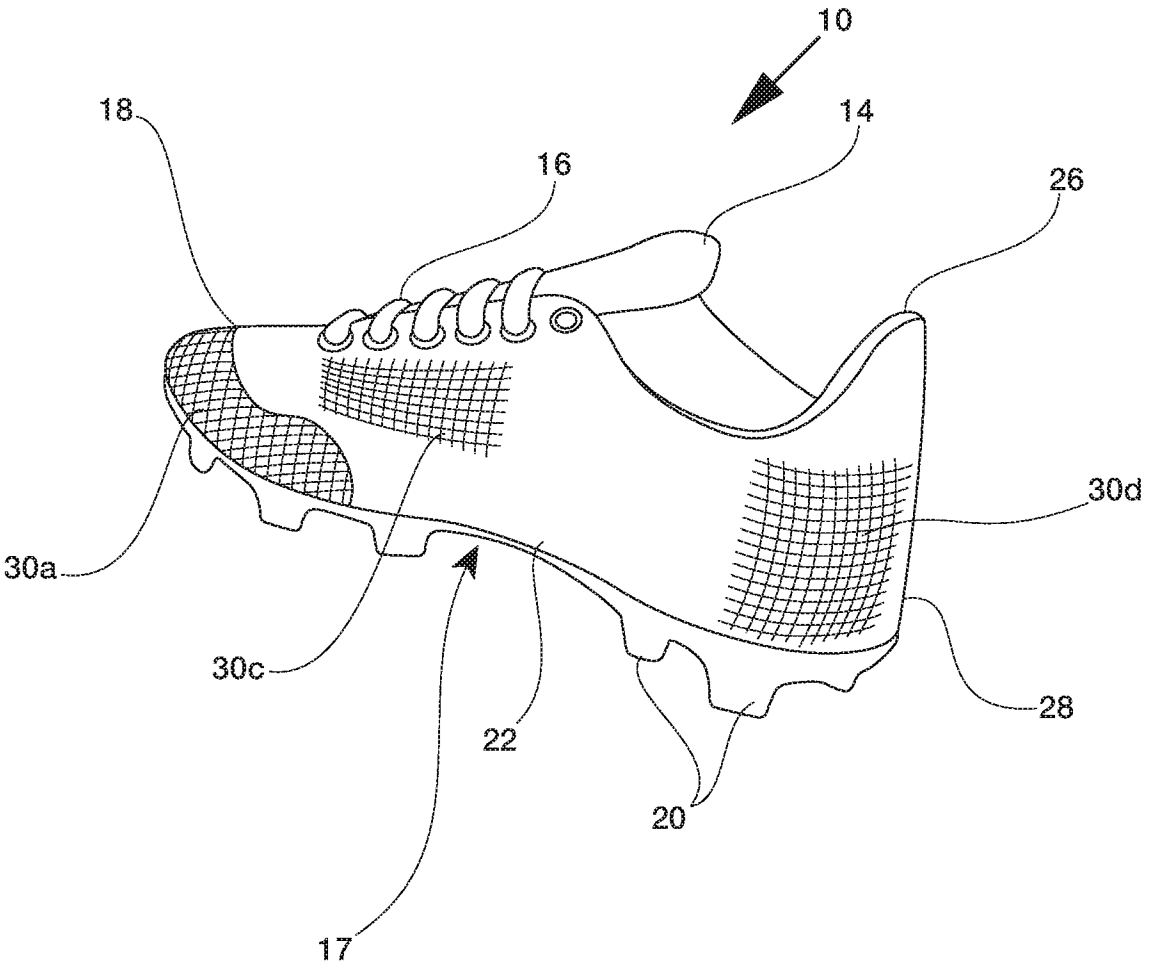
FIG. 2 is an inner perspective view of one example of a sports apparatus having a piezochromic strike area according to embodiments of the present disclosure.
Figure 3:
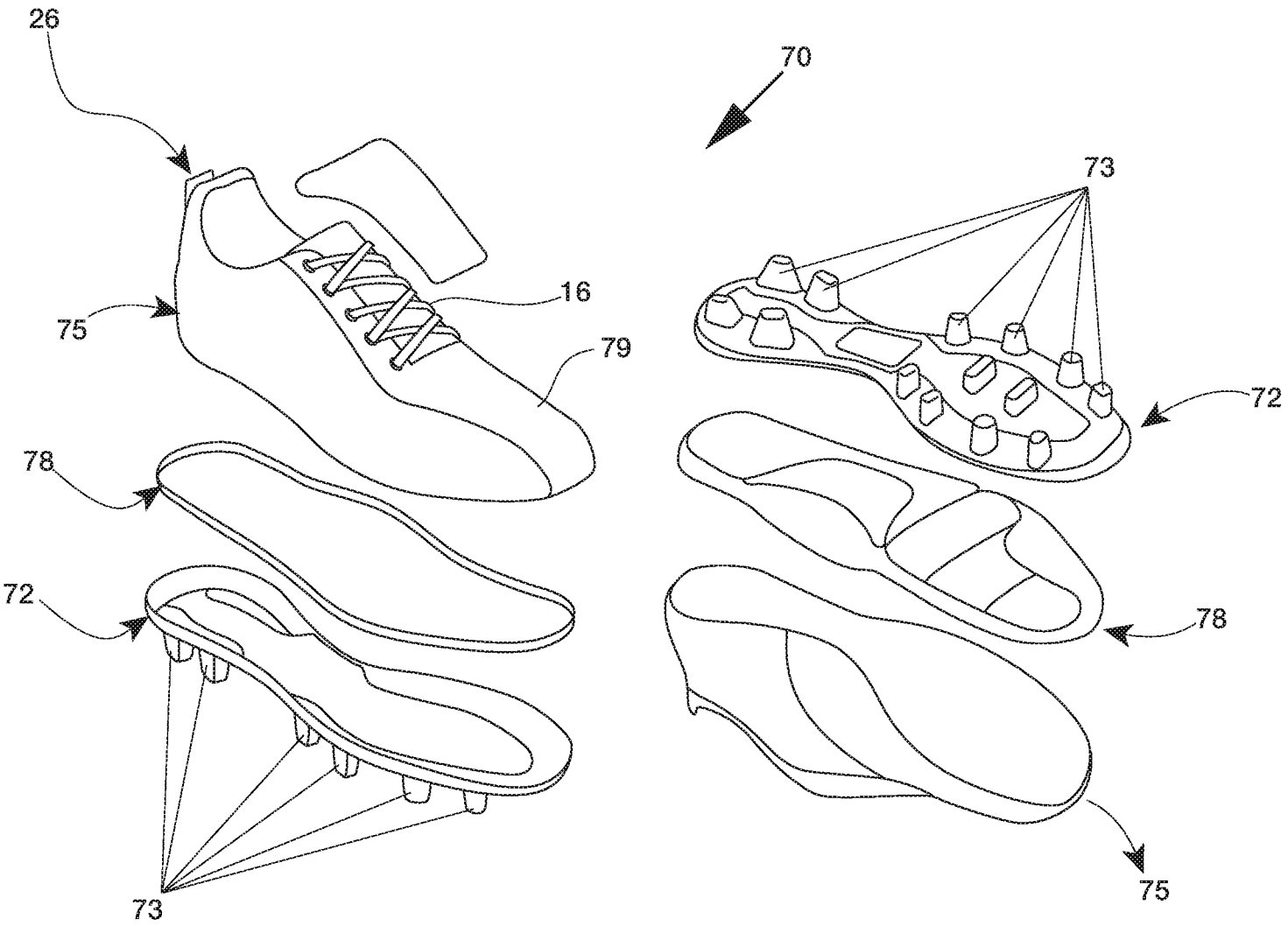
FIG. 3 is an exploded view of one examples of a sports apparatus according to FIGS. 1 and 2.
Figure 4:
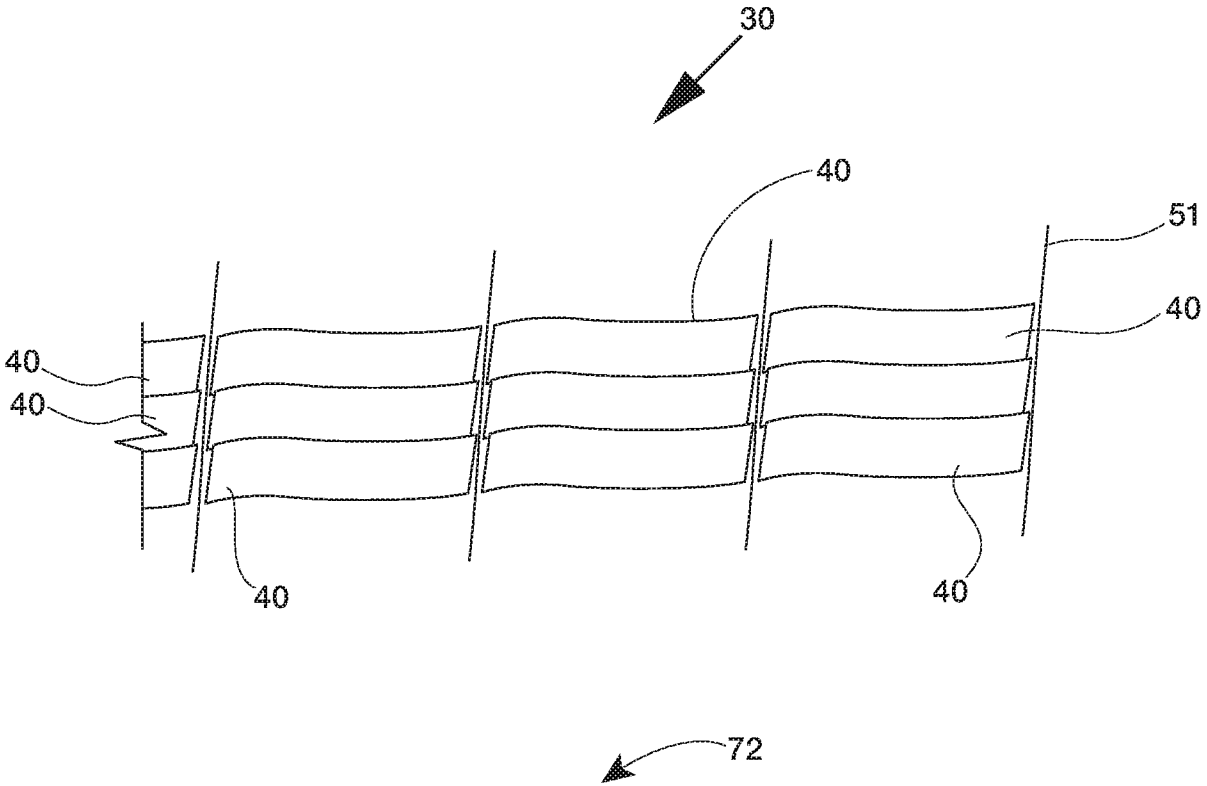
FIG. 4 shows one example of a piezochromic strike area according to examples of the present disclosure.
Figure 5:
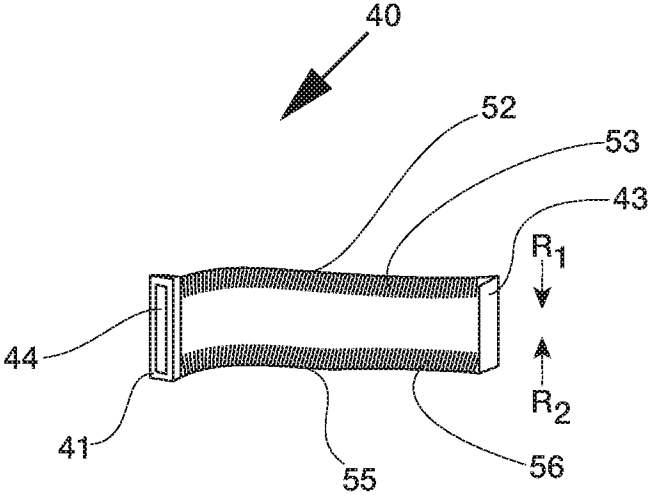
FIG. 5 shows one example of a piezochromic pod according to examples of the present disclosure.

By way of example, a soccer cleat 70 is used to strike the soccer ball in a variety of ways. In some examples, a cleat structure, an example as seen in FIGS. 1-3, may include a sole plate 72, a stud configuration 73 with studs 20, a heel counter 28, an upper 75, a surface layer finish, an inner lining 76, a midfoot/midsole configuration 15, a lacing system 16, a sock liner/liner, a foot bed 78, surface configuration 79, a heel tab 26, and/or differing combinations thereof. Not only would an identifiable strike mark on a cleat be advantageous and desirable for showing details of where and how the ball was struck, a marked strike area could help in diagnosing injury, and clarifying fouls. When incorporating Applicant's piezochromic pods into a cleat the constitution of the cleat must be maintained.

In one embodiment, a soccer cleat 70 may include an upper 75, the upper including a polyurethane lining, a microfiber substrate, and/or a skin. In some examples, the skin may be a leather, contain a leather and/or be or contain a synthetic fiber. Still other examples may include a wire based framework that may be incorporated in in the microfiber substrate. The upper 75 may include a surface configuration 79, by way of example, including and/or dimples. Embodiments may include an upper layer 75 incorporating one or more piezochromic pods 40 that introduce a differential visible color to the cleat when a force is applied to the cleat, by way of example the force of striking a ball. The piezochromic pods may be embedded in the upper layer, by way of example, in the microfiber substrate, in the skin, and/or in both or partially in both. The visible color appearing with a force may be reversible, with the cleat color substantially returning to the original color at a given time after the force has been removed. A color change may be over a spectrum, with an initial color change with an initial impact force, a second color change with continued force impacts within a determined time period (which may be variable depending on the color change constituents used) and then a return to the initial color after an impact free period. In some examples the initial color change to a second color change with continued force impacts may occur, by way of example with a repeated force impact within 5-10 minutes of the initial impact, and return to the initial color may occur when a force impact is absent for at least 10 minutes in some examples, at least 15 minutes in some examples, and in at least 30 minutes, and in 45 minutes in still other examples, or longer.

Some embodiments include, by example, a soccer cleat 70 including one or more strike areas 30 throughout the upper and/or portioned piezochromic strike areas. The piezochromic strike areas 30 may be centralized at the back heel 30*d*, along a distal side 30*b*, along the medial side 30*c*, at the mid-foot, toward the toe 30*a*, and/or a combination of any or all of these or more or less.

Examples of cleats 70 within the scope of the invention may be a soccer cleat including strike areas 30 by way of piezochromic pods 40 located in an overlay on the cleat, and/or a network of pods, interconnected or not, incorporated into a surface of the cleat. The overlay may provide support and cushion to the cleat, while also incorporating piezochromic strike areas 40 incorporated within the overlay.

Figure 10:
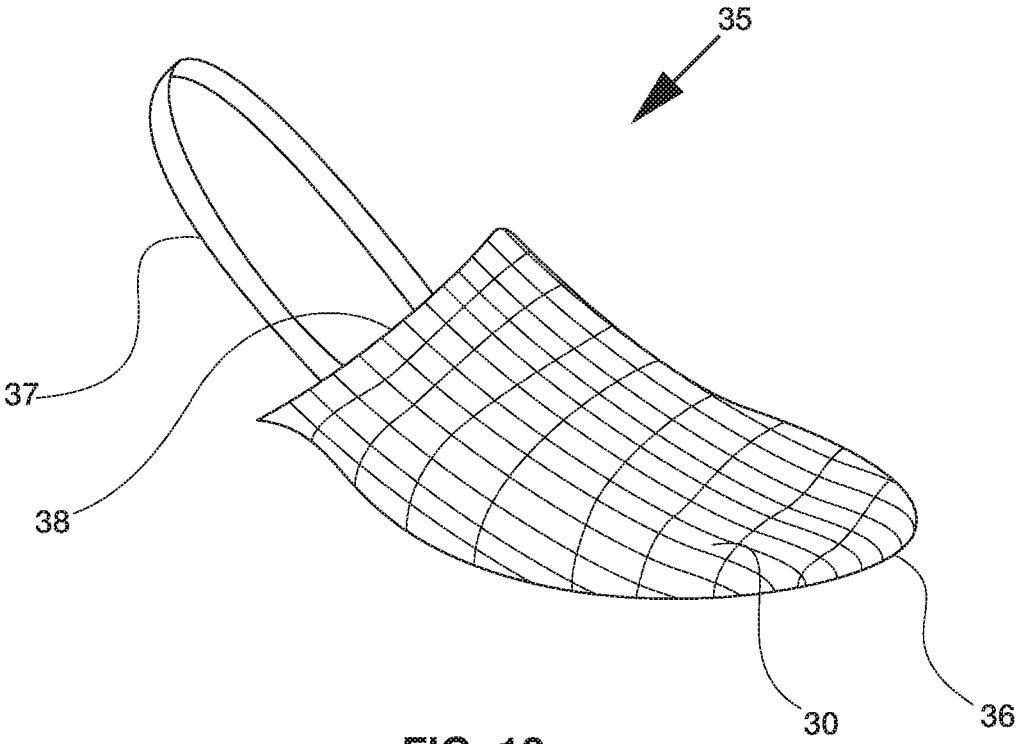
FIG. 10 is a perspective side view of one example of a piezochromic practice cleat fitting according to examples of the present disclosure.

Shown in FIG. 10, a practice cleat fitting 35 may be considered within the scope of the invention. A practice cleat fitting 35 may fit over a cleat and include a toe portion 36 and a back portion 37. The back portion may be, for example, a strap, fitting, elastic band, or lace with the ability to assist in securing the fitting 35 in place on the cleat. The back portion 35 may be at least partially elastic. The fitting 35 may be elastic material that allows the fitting 35 to expand to fit over and onto a cleat and then retract to be secured onto the cleat. The cleat fitting 35 may be disposable after usage. The cleat fitting 35 may be flattened along at last one side in order to fit flush with the surface of a cleat 70. The cleat fitting may include or be made of piezochromic areas 30. The cleat fitting may change colors with a strike impact of a ball. The cleat fitting may have portions that change colors with the strike impact of a ball. The cleat fitting 35, for example, along the toe portion 36 may take on the shape of a sock, webbing, and/or open weave. The cleat fitting may include pods 40.

While an example of a strike area is shown and exemplified on a cleat, similar strike areas on other spots apparatus are considered within the scope of this disclosure.

Numerous characteristics and advantages have been set forth in the foregoing description, together with details of structure and function. Many of the novel features are pointed out in the appended claims. The disclosure, however, is illustrative only, and changes may be made in detail, especially in matters of shape, size, and arrangement of parts, within the principle of the disclosure, to the full extent indicated by the broad general meaning of the terms in which the general claims are expressed. It is further noted that, as used in this application, the singular forms "a," "an," and "the" include plural referents unless expressly and unequivocally limited to one referent.

What is claimed is:

1. A soccer cleat
comprising:
an upper defining a surface layer,
a defined area within the surface layer of the upper configured to strike another surface or implement during a sporting event,
said surface layer of the upper comprising a piezochromic strike area,
at least one strike zone in the defined area;
a series of piezochromic pods embedded within the surface layer and located within the at least one strike zone;
each of said piezochromic pods comprising a first layer of a first material and a second layer of a second material;
wherein the material of the first layer and the material of the second layer intermingle in an activated state when an impact is directed to the at least one strike zone to form a color changing piezochromic strike area visible on the surface layer of the upper the soccer cleat.

2. The apparatus of claim 1 wherein said piezochromic strike area is reversible between a pre-pressure state and an applied pressure state.

3. The apparatus of claim 2 including a delay between a reversal from the applied pressure state back to the pre-pressure state.

4. The apparatus of claim 3 wherein said delay is between about 5 minutes and about 60 minutes.

5. A soccer cleat
comprising:
an upper defining a surface layer,
a defined area within the surface layer of the upper configured to strike another surface of a soccer ball during a sporting event,
said surface layer of the upper comprising a piezochromic strike area,
at least one strike zone in the defined area;
a series of piezochromic pods embedded within the surface layer and located within the at least one strike zone;
each of said piezochromic pods comprising:
a top surface, a bottom surface, a first side and a second side,
a first material and a second material contained within each pod
wherein the first material and the second material may be separated in a resting state and may be interspersed in an activated state;
wherein an impact or force applied to the at least one strike zone acts as a catalyst for the activated state in which a piezochromic reaction occurs to form a color changing piezochromic strike area visible on the surface layer of the upper.

6. The apparatus of claim 5 wherein said piezochromic reaction is reversable.

7. The apparatus of claim 6 including a coating on a surface inside each of said pods.

8. The apparatus of claim 7 including a second coating on a surface inside each of said pods.

9. The apparatus of claim 8 wherein said first surface attracts said first material creating a congregating effect of the first material around the first surface.

10. The apparatus of claim 9 wherein said second surface attracts said second material creating a congregating effect of the second material around the second surface.

11. The apparatus of claim 10 including a middle area where both of the first and second materials do not substantially reside at the same time in the resting state.

12. The apparatus of claim 11 wherein the first material and the second material intersperse in the middle area when said impact or force is applied to the at least one strike zone.

13. The apparatus of claim 12 where in the middle area is a space non-preferred by a first material.

14. The apparatus of claim 5 wherein each of said pods includes a shock absorbing material.

15. The apparatus of claim 5 wherein a surface of each of said pods extends above a surface of the apparatus.

16. A method of indicating a force applied to a strike zone of a soccer cleat, comprising:

said soccer cleat comprising an upper having a surface layer, a defined area within the surface layer of the upper configured to strike another surface or implement during a sporting event, said surface layer of the upper comprising a piezochromic strike area, at least one strike zone in the defined area;

a series of piezochromic pods embedded within the surface layer and located within the at least one strike zone;

each of said piezochromic pods comprising a first layer of a first material and a second layer of a second material;

enabling a color change within each of said piezochromic pods such that the material of the first layer and the material of the second layer intermingle in an activated state when an impact is directed to the at least one strike zone to form a color changing piezochromic strike area visible on the surface layer of the upper;

enabling a return to an original color when an impact is absent; and providing a transparent window in each of said pods so the color change is visible.

17. The method of claim 16 including incorporating a second piezochromic material with each of said pods.

18. The method of claim 17 including allowing a color change from an initial color to a second color, and a color change from a second color back to the initial color.

19. The method of claim 18 including adding an impact resistance to each of said pods.

* * * * *